United States Patent [19]

Reed

[11] Patent Number: 4,636,262

[45] Date of Patent: Jan. 13, 1987

[54] ADDITIVE FOR GREEN MOLDING SAND

[76] Inventor: Edgar H. Reed, P.O. Box 164, Leesburg, N.J. 08327

[21] Appl. No.: 838,363

[22] Filed: Mar. 11, 1986

[51] Int. Cl.[4] ..... B28B 7/34

[52] U.S. Cl. ..... 106/38.3; 106/38.35; 106/38.9

[58] Field of Search ..... 106/38.3, 38.35, 38.9; 164/525, 528

[56] References Cited

U.S. PATENT DOCUMENTS 3,816,145 6/1974 Melcher ..... 106/38.35

4,131,476 12/1978 Melcher et al. ..... 106/38.35

*Primary Examiner*—Lorenzo B. Hayes

*Attorney, Agent, or Firm*—Kenyon & Kenyon

[57] ABSTRACT

A foundry green molding sand composition comprising molding sand, clay and water uniformly admixed with a composition of an alkali metal salt of carboxyhexose or carboxyheptose and an alkanoate salt of magnesium and/or lithium in amounts and proportions sufficient to impart improved green sand properties to said compositions. In the preferred embodiment, the composition is added in the form of about a 50% aqueous solution of sodium glucoheptonate and magnesium acetate which are present in the solution in a weight ratio of about 2:1.

14 Claims, No Drawings

ADDITIVE FOR GREEN MOLDING SAND

BACKGROUND OF THE INVENTION

As is well known, the foundry art is that art dealing with the formation of metal articles by casting processes wherein molten metal is poured into a mold and the metal is cooled to allow it to solidify. By far the largest quantity of castings are made by processes in which the mold is formed from sand, i.e., by sand casting processes. There are several different sand casting processes, but the one employed most often is that employing green molding sand.

Green molding sand has been defined as a "plastic mixture of sand grains, clay, water and other materials which can be used for molding and casting processes. The sand is called 'green' because of the moisture present and is thus distinguished from dry sand." (Heine et al., "Principles of Metal Casting," McGraw-Hill Book Co., Inc., New York (1955), p. 22). Green sand has also been defined as a "naturally bonded sand or a compounded molding-sand mixture which has been tempered with water for use while still in the damp or wet condition." ("Molding Methods and Materials," 1st Ed., The American Foundrymens' Society, Des Plaines (1962)). Such a sand contains water or moisture both in the mold-forming stage and in the metal casting phase. As employed herein, the term "foundry green molding sand" has reference to green molding sands of the type known to and employed by those of ordinary skill in the foundry art comprising molding sand and clay and tempered with water.

As is evident from the foregoing, the essential components of a foundry green molding sand are molding sand, clay and water. The molding sand, which usually is a silica sand (e.g., quartz), but which may be a zircon, olivine or other refractory particulate material having mesh sizes commonly in the range of from about 6 to about 270 mesh, serves largely as a filler and provides the body of the mold. The clay, which is a finely divided (normally less than about 2 microns) material such as montmorillonite (bentonite), illite, kaolinite, fire clay and the like, when plasticized with water, serves as a binder for the sand grains, and imparts the physical strength necessary to enable use of the green molding sand as a mold material. Ordinarily, green molding sands contain from about 5 to about 20 weight percent clay, based upon sand, and sufficient water, normally not greater than about 8 weight percent, based upon sand, to achieve the desired plasticity and other physical properties. The amount of temper water normally is greater when naturally-bonded sands are employed than when synthetic sands are employed.

There are a number of properties which are desired in foundry green molding sands. Among the most important are:

1. Good flowability or compactibility to permit easy pouring of the sand and to allow the sand to move against the pattern under compacting forces;
2. Good physical strength after compaction to permit the mold to retain its shape after removal of the pattern and during casting;
3. Dimensional stability during the casting process;
4. Good internal cohesion of the sand grains and poor adhesion of the sand grains to the cast article; and
5. Good collapsibility after casting to facilitate shakeout.

There are, of course, subsidiary properties which are related to these properties, including compressive strength, permeability, compactibility, mold hardness, green shear, deformation, peel, and the like. In general, a green molding sand typically has properties within the following ranges:

| | |
|---|---|
| Green Compression Strength | 4–40 psi |
| Green Shear Strength | 0.5–10 psi |
| Deformation | 0.005–0.04 in/in |
| Permeability | 6.5–400 |
| Dry Compression Strength | 50–200+ psi |
| Compactibility | 35–65% |

If the deformation or compactibility is too low, the green molding sand is too brittle and cannot withstand handling and pattern removal, while if the deformation is too high, dimensional accuracy cannot be maintained, and the mold, especially one of large mass, e.g., 100 pounds or more, may deform under its own weight. If both green strength and deformation are too high, the sand cannot be readily formed and compacted with existing technology. If permeability is less than 6.5, the vapors generated during casting cannot dissipate rapidly enough and the mold can rupture from gas pressure and molten metal can be ejected out of the sprues. If, on the other hand, the permeability is too high, the molten metal will not be retained in the mold cavity, but will penetrate the voids of the sand. Finally, if the dry strength is too low the sand cannot withstand the erosive effect of the flowing molten metal during casting, while if the dry strength is too high the casting may crack upon solidification.

Green molding sands may be referred to as "soft sands", because they remain plastic and re-formable throughout the mold forming procedure and, in part, during the casting operation. Such molding sands are quite distinct from other molding sands, which may be referred to as "hard sands". These "hard sands", although plastic at the beginning of the molding forming procedure, are hardened and become rigid prior to the casting operation. Hard sands are employed, for example, in investment molding processes, and in forming cores and molds made of resin-bonded sands, or sand formed of sodium silicate or phosphates, or baked drying oil sands. Such hardened sands have compression strengths of the order of 80 to 300 psi or higher. In contrast, green molding sands have compression strengths of the order of about 4 to about 40 psi and preferably about 12 to about 30 psi.

Green molding sands also may be distinguished from "hard sands" because they are readily recycled, it being necessary only to replace temper water and, if desired, organic or other additives lost during the casting process. In contrast, hard sands can be reclaimed only by removal of all materials except for the refractory grains, and complete replacement of the bonding material. As a consequence, hard sands commonly are discarded after one use.

Because of their quite different compositions and mode of use, the problems encountered in green sand casting procedures differ greatly from those of hard sand casting. One such problem is that of control of the amount of temper water to achieve adequate bond strength during both the forming and the casting steps. Slight changes in the amount of water in a green molding sand greatly affect the mechanical properties of the sand. In particular, the dry strength and the hot strength of a green molding sand depend upon the moisture of the sand at compaction; the lower the moisture content, the lower the hot and dry strengths of the sand. For example, a given percentage change in the amount of water has over five times the effect on sand strength as a similar percentage change in the amount of clay or other commonly employed green sand additive.

In general, foundry green molding sands consisting solely of sand, clay and water do not possess an optimum balance of properties. For this reason, a variety of additives have been employed in an effort to improve the properties of green molding sands. Typically, these additives are organic materials which are used as facing agents, expansion control agents and the like. In most cases, these organic additives are useful in improving only one property of the green sand and thus two or more additives may be required. In addition, an additive employed to improve one property frequently has an adverse effect on another property of the green sand mold. For example, sea coal or bituminous coal has been used as a facing agent, and while it does prevent burn-on, it has been found that increased amounts of clay and water are necessary to restore desirable physical properties possessed by the unmodified green sand.

The use of such organic additives is further limited because the total amount of materials which form gaseous materials under the elevated temperatures encountered during casting (i.e., water and organic additives) must be kept below 10 weight percent, based upon the weight of the sand. Excessive amounts of organic materials lead to the generation of more gas than can be dissipated by permeation through the mold body, and would lead to the failure of the mold and the generation of defects in the casting. Normally, the loss of weight on ignition due to volatilization of organic additives should be below about 7 weight percent, and preferably below about 4 weight percent.

Successful attempts to provide efficacious additives to molding sand include U.S. Pat. No. 3,962,550 which discloses that acenaphthylene (HY-PEEL ®) is effective as a facing agent for molding sand, and U.S. Pat. No. 4,131,476 which discloses that salts of lithium or magnesium and an organic carboxylic acid, e.g., magnesium acetate (TAME ®), are effective in improving the properties of hot green molding sand. Unfortunately, neither of these patents discloses products that can act alone to sufficiently improve the properties of green molding sand so as to negate the need for any other additives.

One successful approach at providing a useful and multifaceted additive to solve many of the problems associated with the use of green molding sands is disclosed in U.S. Pat. No. 3,816,145. The additive compound, trihydroxydiphenyl, marketed by Whitehead Brothers Co. as the product "DIKO ®" for use as disclosed in the patent, has proven quite effective in improving the properties of green molding sand. However, resorcinol, the raw material used for the manufacture of the trihydroxydiphenyl which has previously been considered a waste material, has become increasingly unavailable and expensive due to the discovery of other uses for it. Thus, trihydroxydiphenyl is no longer available in sufficient quantity and at sufficiently low price to be of practical value in the foundry industry.

SUMMARY OF THE INVENTION

It is an object of this invention to improve the physical properties of green molding sand.

It is a further object of this invention to provide a relatively inexpensive and readily available additive which improves the physical properties of green molding sand.

These and other objects of the invention, which will be apparent from the ensuing specification, are achieved by a foundry green molding sand composition comprising molding sand, clay and water uniformly admixed with an alkali metal salt of a carboxyhexose or carboxyheptose and an alkanoate salt of magnesium and/or lithium in amounts and proportions sufficient to impart improved green sand properties to said composition.

In the preferred embodiment, improved properties of green molding sand are achieved when the composition is in the form of an aqueous solution, sodium glucoheptonate is the alkali metal salt of a carboxyhexose or carboxyheptose, magnesium acetate is the alkanoate salt, and the sodium glucoheptonate and the magnesium acetate are present in the solution in a weight ratio of about 2:1.

DETAILED DESCRIPTION OF THE INVENTION

It has been found in accordance with this invention that a mixture of an alkali metal salt of a carboxyhexose or carboxyheptose and an alkanoate salt of magnesium and/or lithium is useful as an additive for foundry green molding sands. More importantly, it has been found that a mixture of an alkali metal salt of carboxyhexose or carboxyheptose and an alkanoate salt of magnesium and/or lithium has a beneficial effect on a wide variety of foundry green sand properties with substantially no deleterious effects, while being readily available and relatively inexpensive. As a result, the mixture of the alkali metal salt and the alkanoate salt according to the invention can be readily employed as the sole organic additive to green molding sand, regardless of the casting being made.

The alkali metal salts of carboxyhexose or carboxyheptose according to the invention may be represented by the formula

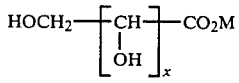

wherein x=4 or 5 and M is an alkali metal. There are, of course, a variety of possible carboxyhexoses and carboxyheptoses; however, gluconic acid and glucoheptonic acid are commonly available and thus their alkali metal salts are preferred. Sodium gluconate and sodium glucoheptonate are especially preferred, with sodium glucoheptonate being most preferred.

The alkanoate salts of lithium and/or magnesium have been disclosed in connection with hot green molding sand in U.S. Pat. No. 4,131,476, the disclosure of which is incorporated herein by reference. The alkanote salts are derived from the lower alkanoic acids, which are those acids containing from 1 to about 6 carbon atoms, including formic acid, acetic acid, propionic acid, butyric acid, hexanoic acid, isobutyric acid, and the like. Acetic acid salts are preferred from the standpoint of economy. The magnesium and lithium salts are comparable in their effect on the properties of green molding sand, but the magnesium salt is preferred from the standpoint of economy. Thus, the use of magnesium acetate is especially preferred for use in the invention.

In addition, at highly elevated temperatures, lithium salts act as fluxes for the sand. Hence, they should not be employed in molds intended for casting steel, but they can be employed for casting aluminum.

It is desirable that the amount of alkali metal salt in the mixture should exceed the amount of the alkanoate salt, with a weight ratio of from about 1.5 to about 3 parts alkali metal salt per part alkanoate salt being generally preferred. A ratio of alkali metal salt to alkanoate salt of about 2:1 is especially preferred.

The alkanoate salt/alkali metal salt mixture can be formed prior to its addition to the molding sand, or it can be formed in situ. It is also possible, in principle, to blend dry alkali metal salt and alkanoate salt with sand and clay. It has been found as a practical matter, however, that the alkanoate salt and alkali metal salt should be pre-mixed in aqueous solution, and that the resulting solution is then admixed with the sand, clay, and, if necessary, additional temper water.

The amount of this solution which is added to the sand is not critical, provided the two active ingredients are present in amounts and proportions sufficient to impart the desired property, e.g., cohesion, facing activity, tempering, plasticity or the like. The actual amount employed in a given case will depend on the particular application, however, including the temperature of the sand, the amount and type of clay binder, and the amount and type of other additives. Normally, the amount of the additive solution which is effective for improving the physical properties of green molding sand is small, of the order of from about 1 to about 5 weight percent, based on the weight of the dry sand, with about 3 weight percent being preferred, depending on the concentration of the active components in the aqueous solution.

The concentration of the two active components in the aqueous solution is also not critical provided that the solution is not so dilute that excessive moisture will be added to the sand to obtain the desired level of additive in the sand. Solutions containing from about 30 to about 60 weight percent of the additive compounds are readily employed. A solution containing equal parts of water and the alkali metal salt/alkanoate salt mixture in the proportions discussed herein is preferred, since green molding sands made employing more concentrated solutions, that is in excess of about 60% of the additive compounds, are generally too viscous to permit ready distribution throughout the sand and tend to "creep", especially in large mold masses (i.e. 100 pounds or more). Less concentrated solutions, e.g., less than about 30% of the additive compounds, are generally considered to be too dilute to be efficacious, and the amount of additive solution would have to be increased to compensate, e.g., to about 5 weight percent or more.

The additive solution is preferably formed by mixing a 50% aqueous solution of sodium glucoheptonate as the alkali metal salt (available commercially from Pfanstiehl Laboratories under the trade name SEQLENE ES-50) with a 50% aqueous solution of magnesium acetate as the alkanoate salt (available commercially from Whitehead Brothers Co. under the trade name TAME®) in amounts sufficient to give the desired ratio of sodium glucoheptonate to magnesium acetate, e.g., 2:1.

The additive according to the invention may be admixed with the green molding sand by any convenient procedure. As stated above, however, it is preferable to add the additive as an aqueous solution, which ensures maximum distribution throughout the bulk of the green molding sand.

In particular, the use of the alkali metal salt and alkanoate salt in accordance with this invention affords the following advantages:

1. The molding sand has good flowability. It is readily formed and compacted around mold patterns of complicated design. It can be readily employed in automatic molding machines. The good flowability permits achievement of a desired sand hardness and apparent bulk density with the expenditure of less compacting energy than with other green molding sands, and the danger of overramming a portion of the mold due to variations in compacting energy is reduced.
2. The compacted sand possesses desirable green strength characteristics at lower moisture contents than are achieved with conventional green molding sands.
3. The additive acts as a facing agent, and prevents burn-on or the fusing of quartz sand grains to the surface of the casting, and promotes excellent finish and peel.
4. The additive reduces shifting of the sand during the casting process, whether it be mold wall movement or enlargement of the mold cavity, or whether it be a localized shifting of the sand resulting in such casting defects as rat-tails, scabs and buckles.
5. The additive permits casting to be effected at lower pouring temperatures and promotes increased fluidity of the metal during casting.
6. The additive yields adequate dry compression strength and yet excellent shakeout is obtained even with green molding sands employing Western bentonite as the clay binder.
7. Finally, the additive is employed at relatively low levels, which in turn minimizes the formation of gas during casting.

The use of an alkanoate salt as a hygroscopic agent to reduce moisture in a sand system is disclosed in U.S. Pat. No. 4,131,476 in connection with hot green molding sands, but, as disclosed in the patent, the alkanoate salt must be combined with some other agent to effect properties such as facing, expansion control and the like which are desirable in a green molding sand additive and are not provided by the alkanoate salt alone. Accordingly, the alkanoate salt is inadequate, by itself, to improve all the properties of green molding sand as does the additive according to the invention. Unexpectedly, it was discovered that the combination of alkanoate salt and alkali metal salt acted not only as a hygroscopic agent, but also acted to improve a host of other properties such as facing action, green strength, flowability and the like as disclosed herein that permits it to be used as the sole organic additive to green molding sand. Moreover, it was unexpected that the two compounds would be as compatible as they have proven to be in solution.

The utility of a mixture of an alkali metal salt with an alkanoate salt is unexpected because the alkali metal salts, as defined hereinbefore, have not been used heretofore as a green sand additive. Rather, one of the alkali metal salts described herein, sodium glucoheptonate, has generally been marketed for use as a metal cleaning agent. It is, therefore, unexpected that a mixture of an alkali metal salt would act to improve the properties of green molding sand.

As noted above, green molding sands normally contain up to about 6 weight percent and typically from about 3 to about 6 weight percent water. When the moisture content of the conventional sands is less than about 3 weight percent, e.g., 2 weight percent, the water evaporates out so rapidly that the sand does not have a useful working life, and at moisture contents of 1 weight percent the sand is not cohesive and cannot be formed into a mold. The alkanoate salt/alkali metal salt composition, as stated above, acts as a humectant, and enables the green molding sand to retain its moisture content at moisture levels below 2.8 weight percent and as low as about 2.2 to 2.4 weight percent or even less. It is when the moisture level climbs above about 2.8 weight percent that undesirable characteristics develop, such as scubs, rat-tails, pinhole porosity, etc. Indeed, the hygroscopic properties of the additive according to the invention are so pronounced that the sand can be retempered without mulling. Thus, retempering can be effected by allowing the molding sand to stand in an atmosphere having a high, e.g., at least about 80%, relative humidity. Alternatively, water can be sprinkled on the sand and allowed to equilibrate after only a minimal degree of mixing or processing effort and time. It is also believed that the alkanoate salt/alkali metal salt mixture, like water, is a plasticizer for the clay binder, and it is this property which enables the formulation of a cohesive green molding sand at low moisture contents, e.g., less than about 2.8 weight percent.

The reduced water content of the green molding sand is believed responsible for a number of advantages. First, less total gas is generated during the casting cycle. The reduction in the amount of gas produced decreases the amount of venting or permeability necessary to allow the gas to escape. As a consequence, sands having higher A.F.S. fineness numbers can be used, thus providing a better casting finish. Secondly, the reduced amounts of water result in the virtual absence of a condensation zone or zone of high moisture content resulting from water vapor transported from the heated mold surface, in the mold mass during the casting cycle. The absence of this zone eliminates defects, such as rat-tails, buckles and scabs normally associated with water expansion in the body of the mold near the cavity surface.

The reduced amounts of water in the mold body permits the use of lower pouring temperatures during casting, since the metal will not be chilled as much through loss of heat to vaporize the water. As a corollary to this, the molten metal can flow into thinner and more complex passages without the need for the more elevated temperatures required by current practice. Thus, the use of the alkanoate salt/alkali metal salt additive contributes to improved metal fluidity and reduces misruns or cold shut.

The reduced amount of water also tends to reduce the degree of burn-on and provides better facing action. It is known that the water present in green sand molds, when heated to casting temperature, provides an oxidizing atmosphere which contributes to burn-on. This contribution is minimized by reducing the water content of the sand.

The reduced amount of water also reduces pinhole porosity of the casting. It is known that water will decompose to its constituent elements, hydrogen and oxygen, at casting temperatures. The hydrogen thus formed can dissolve in the molten metal, causing gas defects known as pinhole porosity. These defects are reduced when the amount of water in the green sand mold is reduced.

Finally, the reduced moisture content of the sand is believed responsible for improved shakeout, especially when Western bentonite is employed as the clay binder. It is known that the dry compression strength developed with green molding sands employing Western bentonite increases with increasing moisture content of the green sand. Since a reduced moisture content is feasible with the invention, reduced dry strengths and thus improved shakeout result.

The alkanoate salt/alkali metal salt additive according to the invention has other properties which contribute to its desirability as a green molding sand additive. For example, on pyrolysis, these compounds form a fine, honeycomb, coke-like structure which, it is believed, tends to "lock up" the sand grains with a bond in addition to that afforded by the clay. This bond further retards shifting of the sand grains and, in particular, is believed responsible for limiting mold wall movement and cavity enlargement. In addition, the alkanoate salt/alkali metal salt mixture, like other carbonaceous materials, forms a non-oxidizing atmosphere at casting temperatures, which contributes to its facing activity.

Still another desirable property of the alkanoate salt/alkali metal salt additive is its apparent ability, in combination with the clay binder, to impart lubricity to the sand grains comprising the green sand, and to permit them to slide past one another prior to compaction. It is this property which is believed responsible for the good flowability of the uncompacted green molding sand, as well as the ability of the sand to be compacted to high apparent bulk densities with the expenditure of reduced compacting energy. Moreover, the increased flowability reduces the criticality of variations in compacting energy over the mold, and renders the sand less susceptible to expansion defects caused by overramming. As a result, excellent molds can be made even by less skilled molders. Despite the good flowability of the uncompacted sand, the alkanoate salt/alkali metal salt additive imparts strong cohesion of the sand grains of the compacted sand. Generally, the cohesion is higher than that of the adhesion of the sand to the metal, thus rendering parting agents unnecessary. Thus, fine details are not lost.

The solution is admixed with the sand and clay in any suitable manner. The temperature of the solution is not critical provided the solution is sufficiently fluid to be easily dispersed throughout the sand of clay.

The additive can be mixed directly with a natural or synthetic molding sand, or it can be added in combination with other additives, such as clay binders of the bentonite, ilmenite or kaolinitic type. In this regard, it has been found that the additive acts as an activator and plasticizer for clays of this type, and these compositions are able to develop high green strength with the attendant advantage of low water content, permeability and the like imparted by the clay binder. Thus, a molding sand including both the additive of this invention and a clay binder has extremely desirable properties.

Although the alkali metal salt/alkanoate salt mixture is most commonly admixed with the sand prior to forming the green sand mold, it is also useful as a face dressing or facing agent and can be applied to the mold surface after the mold has been formed. The additive solution may be applied to the mold surface by any convenient technique, as by brushing or spraying, with spraying being preferred. When spraying is employed, airless spray techniques are preferred to minimize the incident of air-entrained particles. The solution diffuses into the sand at the mold surface without leaving a residue at the surface. Thus, there is no loss of detail, such as is encountered with commonly employed surface sprays or washes containing fine particles of an inorganic refractory material.

When used in this manner as a face dressing or facing agent, the concentration of the alkali metal salt and alkanoate salt composition is not critical, provided the solution has a consistency which permits its application to the mold surface and yet contains sufficient composition to permit application of the desired amount to the surface without requiring excessive amounts of solution. In general, however, amounts of alkali metal salt and alkanoate salt as disclosed herein have been found satisfactory for application as a spray.

The following example is illustrative. All parts and percentages are by weight unless otherwise specified.

EXAMPLE

Molding sand compositions containing 90 grams of a solution of sodium glucoheptonate and magnesium acetate, 3000 grams sand (80 AFS), 210 grams Western bentonite clay (7%) and 90 grams of water (1%) were made up. To a composition of the sand and water was added 90 grams of an aqueous solution containing approximately one-third by weight of a 50% aqueous solution of TAME brand of magnesium acetate and two-thirds by weight of a 50% aqueous solution of SEQLENE ES-50 brand of sodium glucoheptonate. The resulting composition was mulled for three minutes, following which the Western bentonite clay was added and the entire mixture was mulled for an additional twelve minutes.

A control molding sand composition containing 3000 grams of sand (80 AFS), 210 grams Western bentonite Clay (7%) and 120 grams water (4%) was made up. The water was added to the sand and mulled for three minutes, following which the Western bentonite Clay was added and the entire mixture was then mulled for an additional twelve minutes.

Comparative testing was performed using various grades (AFC #) of sand, and the molding sand compositions were evaluated for percent moisture, green compressive strength and green shear strength. The data are summarized in tabular form as follows:

| COMPOSITIONS | % MOISTURE | GREEN COMPR. STR. PSI | GREEN SHEAR STR. PSI |
|---|---|---|---|
| CONTROL<br>Western Bentonite<br>Water | 3.6 | 14.8 | 3.7 |
| Western Bentonite<br>Water<br>Magnesium Acetate/<br>Sodium glucoheptonate | 1.8 | 24.6 | 5.8 |

It is readily apparent that the molding sand test compositions incorporating the aqueous compositions of an alkanoate salt and an alkali metal salt were superior to the corresponding control in green physical properties, despite the presence of less than 2 percent water in the molding sand.

While there have been described what are presently believed to be preferred embodiments of the invention, it will be apparent to a person skilled in the art that numerous changes can be made in the ingredients, conditions and proportions set forth in the foregoing embodiments without departing from the invention as described herein and as defined in the appended claims.

What is claimed is:

1. An improved foundry green molding sand composition comprising molding sand, clay and water, wherein the improvement comprises the presence, in said composition in amounts and proportions sufficient to impart improved green sand properties to said composition an alkanoate salt of magnesium and/or lithium and an alkali metal salt of carboxyhexose or carboxyheptose of the formula

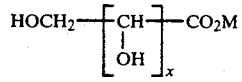

wherein x=4 or 5 and M is an alkali metal salt.

2. A mixture according to claim 1, containing up to about 5 parts of a mixture of said alkali metal salt and alkanoate salt per 100 parts of molding sand.

3. A composition according to claim 1 containing from about 1 to about 3 parts of a mixture of said alkali metal salt and alkanoate salt per 100 parts of molding sand.

4. A composition according to claim 1, wherein the alkali metal salt and the alkanoate salt are present in a weight ratio of from about 1.5:1 to about 3:1.

5. A composition according to claim 4, wherein the alkali metal salt and the alkanoate salt are present in a weight ratio of about 2:1.

6. A foundry sand additive comprising an aqueous solution of an alkanoate salt of magnesium and/or lithium and an alkali metal salt of carboxyhexose or carboxyheptose of the formula

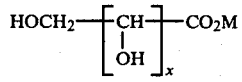

wherein x=4 or 5 and M is an alkali metal salt, wherein said solution contains from about 30 weight percent to about 60 weight percent of a mixture of said alkali metal salt and alkanoate salt in a weight ratio of alkali metal salt to alkanoate salt of about 1.5:1 to about 3:1.

7. The additive according to claim 6, wherein sodium glucoheptonate is the alkali metal salt and magnesium acetate is the alkanoate salt and wherein said additive contains about 50 weight percent of a mixture of sodium glucoheptonate and magnesium acetate in a weight ratio of sodium glucoheptonate to magnesium acetate of about 2:1.

8. An improved foundry green molding sand composition comprising molding sand, clay and water, wherein the improvement comprises the presence of sodium glucoheptonate and magnesium acetate in said composition in amounts and proportions sufficient to impart improved green sand properties to said composition.

9. A composition according to claim 8 containing up to about 5 parts of a mixture of said sodium glucoheptonate and magnesium acetate per 100 parts of molding sand.

10. A composition according to claim 8 containing from about 1 to about 3 parts of a mixture of said sodium glucoheptonate and magnesium acetate per 100 parts of molding sand.

11. A composition according to claim 8, wherein the sodium glucoheptonate and magnesium acetate are present in a weight ratio of from about 1.5:1 to about 3:1.

12. A composition according to claim 11 wherein the sodium glucoheptonate and magnesium acetate are present in a weight ratio of about 2:1.

13. A foundry sand additive comprising an aqueous solution of magnesium acetate and sodium glucoheptonate containing from about 30 weight percent to about 60 weight percent of a mixture of magnesium acetate and sodium glucoheptonate in a weight ratio of sodium glucoheptonate to magnesium acetate of about 1.5:1 to about 3:1.

14. The additive according to claim 13, containing about 50 weight percent of a mixture of sodium glucoheptonate and magnesium acetate in a weight ratio of sodium glucoheptonate to magnesium acetate of about 2:1.

* * * * *